US011974605B2

(12) United States Patent
Jang et al.

(10) Patent No.: US 11,974,605 B2
(45) Date of Patent: May 7, 2024

(54) AEROSOL GENERATING DEVICE PROVIDING AN AEROSOL TRANSFER AMOUNT AND SUCTION RESISTANCE

(71) Applicant: KT&G CORPORATION, Daejeon (KR)

(72) Inventors: Yong Joon Jang, Daejeon (KR); Chul Ho Jang, Daejeon (KR); Ga Hee Lim, Daejeon (KR); Sun Jin Jin, Seoul (KR)

(73) Assignee: KT&G CORPORATION, Daejeon (KR)

( * ) Notice: Subject to any disclaimer, the term of this patent is extended or adjusted under 35 U.S.C. 154(b) by 589 days.

(21) Appl. No.: 17/270,495

(22) PCT Filed: Jun. 26, 2020

(86) PCT No.: PCT/KR2020/008351
§ 371 (c)(1),
(2) Date: Feb. 23, 2021

(87) PCT Pub. No.: WO2021/006508
PCT Pub. Date: Jan. 14, 2021

(65) Prior Publication Data

US 2021/0337869 A1 Nov. 4, 2021

(30) Foreign Application Priority Data

Jul. 5, 2019 (KR) ..... 10-2019-0081513

(51) Int. Cl.
*A24F 40/46* (2020.01)
*A24F 40/20* (2020.01)
(Continued)

(52) U.S. Cl.
CPC ..... *A24F 40/46* (2020.01); *A24F 40/20* (2020.01); *A24F 40/485* (2020.01); *A24F 40/57* (2020.01)

(58) Field of Classification Search
CPC ..... A24F 40/46; A24F 40/20; A24F 40/485
See application file for complete search history.

(56) References Cited

U.S. PATENT DOCUMENTS 11,246,342 B2 * 2/2022 Mahler ..... A24F 40/42
2014/0109905 A1 4/2014 Yamada et al.
(Continued)

FOREIGN PATENT DOCUMENTS

CA 3 047 236 A1 6/2018
CN 107205494 A 9/2017
(Continued)

OTHER PUBLICATIONS

International Search Report of PCT/KR2020/008351 dated Oct. 8, 2020 [PCT/ISA/210].
(Continued)

*Primary Examiner* — Hae Moon Hyeon
(74) *Attorney, Agent, or Firm* — Sughrue Mion, PLLC

(57) ABSTRACT

Provided is an aerosol generating device. The aerosol generating device includes: an accommodation part into which a cigarette is capable of being inserted; and a heating element passing through a hole formed in a bottom surface of the accommodation part, protruding into the accommodation part and capable of heating the cigarette inserted into the accommodation part, wherein, on the bottom-surface, the ratio of a cross-sectional area of the hole with respect to a cross-sectional area of the heating element is greater than or equal to 1.8.

11 Claims, 10 Drawing Sheets

(51) Int. Cl.
*A24F 40/485* (2020.01)
*A24F 40/57* (2020.01)

(56) References Cited

U.S. PATENT DOCUMENTS

| | | | | |
|---|---|---|---|---|
| 2017/0055580 | A1* | 3/2017 | Blandino | H05B 6/36 |
| 2018/0049472 | A1* | 2/2018 | Mahler | A61M 15/0023 |
| 2020/0154765 | A1 | 5/2020 | Lee et al. | |
| 2020/0187555 | A1 | 6/2020 | Lee | |
| 2020/0352231 | A1 | 11/2020 | Han et al. | |
| 2020/0359682 | A1 | 11/2020 | Han et al. | |
| 2021/0112855 | A1* | 4/2021 | Watanabe | A24B 15/28 |
| 2022/0125105 | A1 | 4/2022 | Mahler et al. | |

FOREIGN PATENT DOCUMENTS

| | | | |
|---|---|---|---|
| CN | 206923676 | U | 1/2018 |
| CN | 207023243 | U | 2/2018 |
| CN | 108113051 | A | 6/2018 |
| CN | 207653580 | U | 7/2018 |
| CN | 207836767 | U | 9/2018 |
| CN | 208941044 | U | 6/2019 |
| EP | 3 494 809 | A1 | 6/2019 |
| KR | 10-2017-0115492 | A | 10/2017 |
| KR | 10-2018-0070453 | A | 6/2018 |
| KR | 10-2018-0070454 | A | 6/2018 |
| KR | 10-2019-0029780 | A | 3/2019 |
| KR | 10-2019-0038182 | A | 4/2019 |
| WO | 2018/190606 | A1 | 10/2018 |
| WO | 2019/050131 | A1 | 3/2019 |

OTHER PUBLICATIONS

Extended European Search Report dated Jan. 24, 2022 in European Application No. 20785665.9.
Office Action dated Dec. 7, 2021 in Japanese Application No. 2020-558496.
Office Action dated Apr. 21, 2023 from the Chinese Patent Office in Application No. 202080005890.9.

* cited by examiner

AEROSOL GENERATING DEVICE PROVIDING AN AEROSOL TRANSFER AMOUNT AND SUCTION RESISTANCE

CROSS REFERENCE TO RELATED APPLICATIONS

This application is a National Stage of International Application No. PCT/KR2020/008351 filed on Jun. 26, 2020, claiming priority based on Korean Patent Application No. 10-2019-0081513 filed on Jul. 5, 2019.

TECHNICAL FIELD

The present disclosure relates to an aerosol generating device, and more particularly, to an aerosol generating device which includes a hole into which a heating element of a heater may be inserted and which includes an accommodation part for accommodating a cigarette.

BACKGROUND ART

Recently, the demand for alternative methods to overcome the shortcomings of general cigarettes has increased. For example, there is an increasing demand for a method of generating aerosol by heating an aerosol generating material in cigarettes, rather than by burning cigarettes. Recently, the demand for alternative methods to overcome the shortcomings of general cigarettes has increased.

A hole into which a heating element of a heater is inserted, may be formed in an accommodation part of such an aerosol generating device in which a cigarette is accommodated, and external air flows into the accommodation part through the hole according to a user's puff and then passes through the inside of the cigarette to deliver aerosols to the user. At this time, an aerosol generating device is required to be designed with an appropriate aerosol transfer amount and suction resistance in order to provide an enhanced sense of smoking to the user.

DESCRIPTION OF EMBODIMENTS

Technical Problem

According to an aspect of the present disclosure, an aerosol generating device in which aerosols are designed considering an accommodation part into which a cigarette is inserted, a heating element, and a hole formed in the accommodation part and into which the heating element is inserted, so that an appropriate aerosol transfer amount and suction resistance may be provided.

The problem to be solved through the embodiments is not limited to the above-described problem, and the problems that are not mentioned can be clearly understood by those of ordinary skill in the art from the present disclosure and the accompanying drawings.

Technical Solution to Problem

An aerosol generating device may include an accommodation part into which a cigarette is capable of being inserted, and a heating element passing through a hole formed in a bottom surface of the accommodation part, protruding into the accommodation part and capable of heating the cigarette inserted into the accommodation part, wherein, on the bottom-surface, the ratio of a cross-sectional area of the hole with respect to a cross-sectional area of the heating element is greater than or equal to 1.8.

Advantageous Effects of Disclosure

One effect according to the embodiments is that aerosols are designed considering an accommodation part into which a cigarette is inserted, a heating element, and a hole formed in the accommodation part and into which the heating element is inserted, so that an enhanced feeling of smoking may be provided to a user through an appropriate aerosol transfer amount and suction resistance.

The effects by the embodiments are not limited to the above-described effects, and effects that are not mentioned will be clearly understood by those of ordinary skill in the art from the present specifications and the accompanying drawings.

BEST MODE

Figure 1:
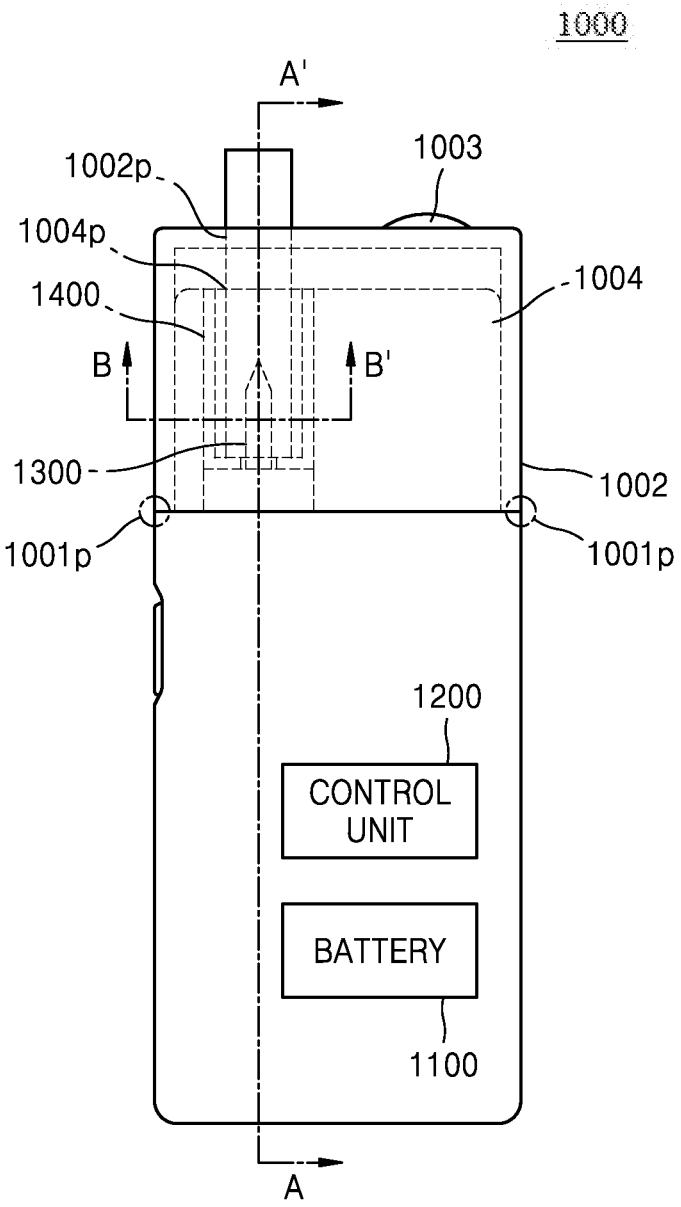
FIG. 1 is a front view illustrating an aerosol generating device according to an embodiment.

An aerosol generating device according to an embodiment may include an accommodation part into which a cigarette is capable of being inserted; and a heating element passing through a hole formed in a bottom surface of the accommodation part, protruding into the accommodation part and capable of heating the cigarette inserted into the accommodation part, wherein, on the bottom-surface, the ratio of a cross-sectional area of the hole with respect to a cross-sectional area of the heating element may be greater than or equal to 1.8.

The ratio of a cross-sectional area of the hole with respect to a cross-sectional area of the heating element may be less than and equal to 3.6.

When the ratio of a cross-sectional area of the hole with respect to a cross-sectional area of the heating element is greater than and equal to 1.8, suction resistance against air passing through an inside of the accommodation part through a gap formed due to a difference in the cross-sectional areas of the heating element and the hole may be stabilized.

When the ratio of a cross-sectional area of the hole with respect to a cross-sectional area of the heating element is greater than and equal to 1.8, aerosol transfer through the cigarette may be promoted.

When the ratio of a cross-sectional area of the hole with respect to a cross-sectional area of the heating element is less than and equal to 3.6, leakage of the aerosol generating material separated from the cigarette through a gap formed due to cross-sectional areas of the heating element and the hole may be prevented.

The accommodation part may extend along an axis, and a bottom surface of the accommodation part may be on a plane perpendicular to the axis.

The accommodation part may extend along an axis, the heating element may pass through the hole in a first direction of the axis, and the cigarette may be inserted into the accommodation part in a second direction of the axis.

The hole may be formed along a shape of the heating element so that the heating element passes through the hole.

The heating element may be an elongating-type heating element, and a cross-sectional area of the heating element may be circular.

The hole may be circular.

The aerosol generating device may further include an inlet into which external air is introduced, when a user puffs.

The aerosol generating device may further include a battery configured to supply power to the heating element and a control unit configured to control a heating operation of the heating element.

An aerosol generating device according to another embodiment may include an accommodation part into which a cigarette is capable of being inserted, and a heating element passing through a hole formed in a bottom surface of the accommodation part, protruding into the accommodation part and capable of heating the cigarette inserted into the accommodation part, wherein, on the bottom surface, the ratio of a cross-sectional area of the hole with respect to a cross-sectional area of the cigarette may be greater than and equal to 0.2.

On the bottom surface, the ratio of a cross-sectional area of the hole with respect to a cross-sectional area of the cigarette may be less than or equal to 0.3

The heating element may be inserted into the cigarette and heated to form a temperature distribution in the cigarette that is changed according to a distance from the heating element, and a region in which air flows into the cigarette through the hole, may be determined according to the ratio of a cross-sectional area of the hole with respect to a cross-sectional area of the cigarette.

Mode of Disclosure

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Throughout the specification, an aerosol generating device may be a device that generates aerosols using an aerosol generating material to generate aerosols that are capable of being directly inhaled into a user's lungs through a user's mouth. For example, the aerosol generating device may be a holder.

Throughout the specification, the term "puff" refers to the user's inhalation, and the inhalation may refer to a situation in which the user's oral cavity, nasal cavity, or lungs are drawn through the user's mouth or nose.

Hereinafter, embodiments of the present disclosure will be described in detail with reference to the accompanying drawings so that those of ordinary skill in the art may easily implement the present disclosure. However, the present disclosure may be implemented in various different forms, and is not limited to the embodiments described herein.

Figure 2:
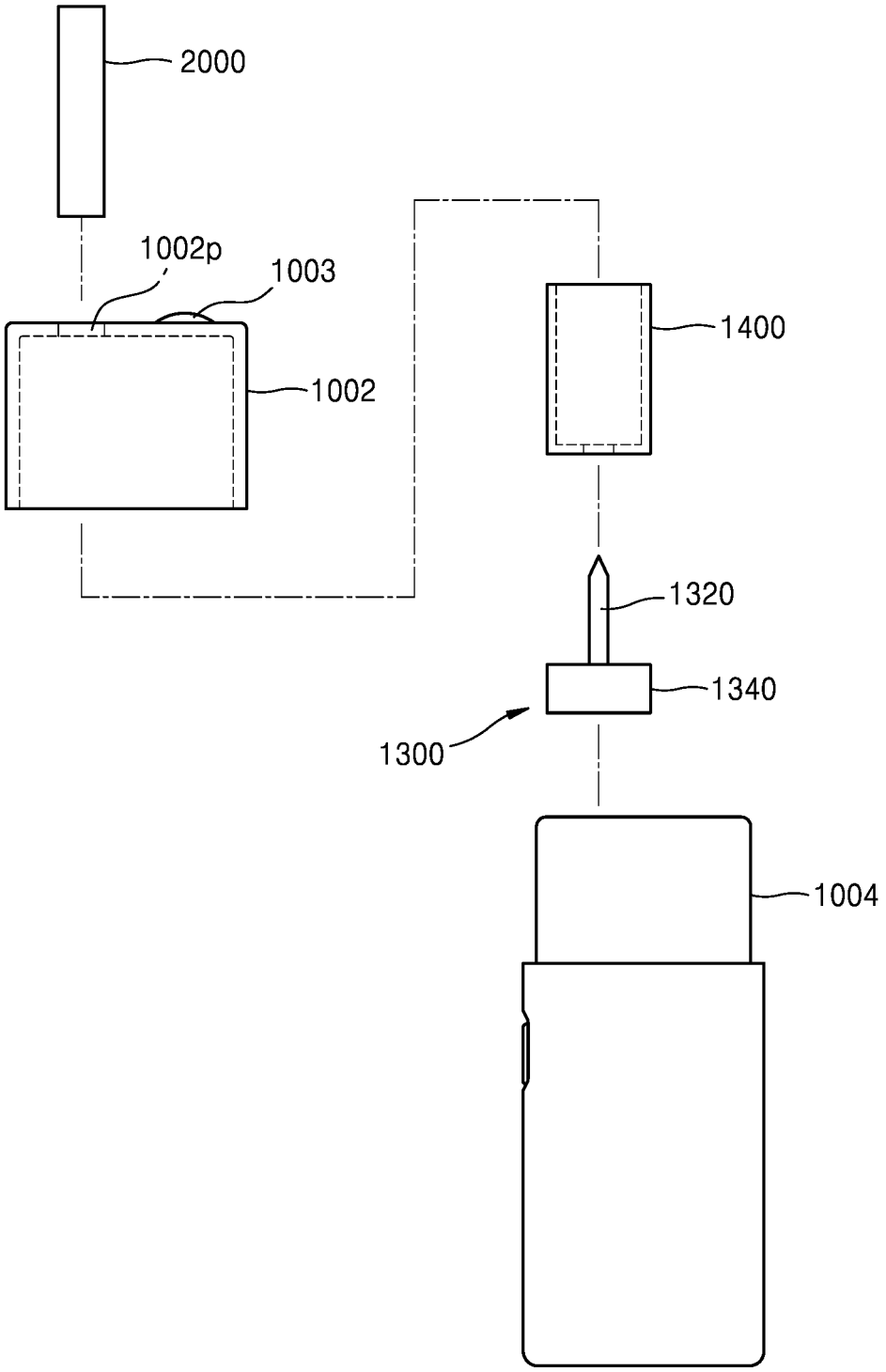
FIG. 2 is an exploded view of the aerosol generating device of FIG. 1.

FIG. 1 is a front view of an aerosol generating device according to an embodiment, and FIG. 2 is an exploded view of the aerosol generating device of FIG. 1.

Referring to FIG. 1, the aerosol generating device 1000 may include a battery 1100, a control unit 1200, a heater 1300, and an accommodation part 1400. Also, the cigarette 2000 may be inserted into an inner space of the aerosol generating device 1000.

FIG. 1 shows the aerosol generating device 1000 with some elements related to the embodiment. Therefore, it will be understood by one of ordinary skill in the art related to the present embodiment that other general-purpose components may be further included in the aerosol generating device 1000, in addition to the components illustrated in FIG. 1.

FIG. 1 illustrates that the battery 1100, the control unit 1200, the heater 1300, and the accommodation part are arranged in series, but the arrangement of these are not limited thereto. In other words, according to the design of the aerosol generating device 1000, the arrangement of the battery 1100, the control unit 1200, the heater 1300, and the accommodation part 1400 may be modified.

When the cigarette 2000 is inserted into the aerosol generating device 1000, the aerosol generating device 1000 heats the heater 1300. The temperature of an aerosol generating material in the cigarette 2000 is raised by the heated heater 1300, and thus aerosol is generated. The generated aerosol is delivered to a user through a filter 2200 of the cigarette 2000.

According to necessity, even when the cigarette 2000 is not inserted into the aerosol generating device 1000, the aerosol generating device 1000 may heat the heater 1300.

The battery 1100 may supply power to be used for the aerosol generating device 1000 to operate. For example, the battery 1100 may supply power for heating the heater 1300 and supply power for operating the control unit 1200. Also, the battery 1100 may supply power for operations of a display, a sensor, a motor, etc. mounted in the aerosol generating device 1000.

The control unit 1200 may generally control operations of the aerosol generating device 1000. In detail, the control unit 1200 controls not only operations of the battery 1100 and the heater, but also operations of other components included in the aerosol generating device 1000. Also, the control unit 1200 may check a state of each of the components of the aerosol generating device 1000 to determine whether or not the aerosol generating device 1000 is able to operate.

The control unit 1200 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 1300 is heated by power supplied from the battery 1100. For example, when the cigarette 2000 is inserted into the aerosol generating device 1000, the heater 1300 may be located inside the cigarette 2000. Thus, the heated heater 1300 may increase a temperature of an aerosol generating material in the cigarette 2000.

The heater 1300 may include a heating element 1320. The heating element 1320 may dissipate heat through its surface. The heating element 1320 may be inserted into the cigarette 2000 to be in contact with or close to an aerosol generating material including a tobacco rod 2100 and may vaporize the aerosol generating material by heat. The heating element 1320 may be an elongating-type heating element, for example, and may include a tube-type heating element 1320, a plate-type heating element 1320, a needle-type heating element 1320 or a rod-type heating element.

The heater 1300 may include a support 1340. The support 1340 may be fixed in such a way that the heating element 1320 may pass through the hole 1400*h* of the accommodation part 1400 and may be inserted into the cigarette 200. The support 1340 may be hung in the accommodation part 1400 so that a length at which the heating element 1320 is accommodated, may be determined.

According to an embodiment, the support 1340 may provide a space in which electric wiring or connection terminals for transferring power supplied from the battery 1100 to the heating element 1320 are arranged.

The heater 1300 may include an electro-resistive heater. For example, the heater 1300 may include an electrically conductive track, and the heater 1300 may be heated when currents flow through the electrically conductive track. However, the heater 1300 is not limited to the example described above and may include all heaters which may be heated to a desired temperature. Here, the desired temperature may be pre-set in the aerosol generating device 1000 or may be set as a temperature desired by a user.

As another example, the heater 1300 may include an induction heater 1300. In detail, the heater 1300 may include an electrically conductive coil for heating a cigarette 2000 in an induction heating method, and the cigarette 2000 may include a susceptor which may be heated by the induction heater 1300.

Also, the aerosol generating device 1000 may include a plurality of heaters 1300. Here, the plurality of heaters 1300 may be inserted into the cigarette 2000 or may be arranged outside the cigarette 2000. Also, some of the plurality of heaters 1300 may be inserted into the cigarette 2000, and the others may be arranged outside the cigarette 2000. In addition, the shape of the heater 1300 is not limited to the shape illustrated in FIG. 1, and may include various shapes.

The accommodation part 1400 may be a structure that extends along an axis and includes an empty space therein. The cigarette 2000 may be inserted in and accommodated in the empty space of the accommodation part 1400. The cigarette 2000 may be inserted from top to bottom along an axis.

The shape and size of the empty space may be manufactured according to the shape and size of the cigarette 2000. For example, the empty space may be cylindrical to accommodate the cylindrical cigarette 2000, and may have a size identical to or similar to the size of the cigarette 2000 so that the cigarette 2000 may be fixed inside the empty space.

An insertion hole 1004*p*, which is an opening above the empty space, may be connected to an outer hole 1002*p* of a cover 1002 to provide a passage into which the cigarette 2000 is inserted. A bottom wall or bottom surface 1400*b* of the accommodation part 1400 may set a limitation position into which the cigarette 2000 is inserted.

The accommodation part 1400 may be coupled to the heater 1300. The accommodation part 1400 may be coupled to the heater 1300 and installed at an upper portion of a case 1004. The upper portion of the case 1004 and the accommodation part 1400 may be concealed when the cover 1002 is coupled.

A hole 1400*h* may be formed in the bottom surface 1400*b* of the accommodation part 1400. The heating element 1320 of the heater 1300 may pass through the hole 1400*h* and protrude into the accommodation part 1400. The shape and size of the hole 1400*h* may correspond to the shape and size of the heating element 1320. For example, when the heating element 1320 has a circular cross-section, the hole 1400*h* may also have a circular cross-sectional shape, and the cross-sectional area S1 of the hole 1400*h* may be greater than the cross-sectional area S2 of the heating element 1320 so that the inner surface of the hole 1400*h* may be apart from the outer surface of the heating element 1320. Airflow may move through a gap formed by a difference in cross-sectional area between the hole 1400*h* and the heating element 1320. This will be described in more detail with reference to FIGS. 4 to 6.

According to an embodiment, the bottom wall or bottom surface 1400*b* of the accommodation part 1400 is a plane perpendicular to the axis. The cigarette 2000 may be inserted from top to bottom along an axis in which the accommodation part 1400 extends, and the heating element 1320 may pass through the hole 1400*h* from bottom to top along the axis. Thus, the heating element 1320 may enter the inside of the cigarette 2000 along the axis, and a length at which the outer surface of the heating element 1320 is in contact with the aerosol generating material inside the cigarette 200, may be maximized.

The sidewall of the accommodation part 1400 may perform an insulating function so that internal heat may not be dissipated to the outside. According to an embodiment, the aerosol generating device 1000 may further include a holder that protects the accommodation part 1400 by surrounding it.

When the user inserts the cigarette 2000 into the accommodation part 1400, the cigarette 2000 moves along an accommodation passage 1004*h* and then the end of the cigarette 2000 reaches the bottom surface 1400*b* of the accommodation part 1400, a feeling of contact between the bottom surface 1004*b* and the end of the cigarette 2000 is transmitted to the user's hand holding the cigarette 2000. Thus, the user may easily mount the cigarette 2000 on the aerosol generating device 1000 by performing a simple operation of holding the cigarette 2000 in his/her hand and pushing the cigarette 2000 into the insertion hole 1004*p* of the accommodation part 1400.

The aerosol generating device 1000 may be manufactured in a structure in which external air may be introduced or internal gas may flow out even in a state where the cigarette 2000 is inserted.

The aerosol generating device 1000 may include a case 1004 and a cover 1002. The cover 1002 may be coupled to one end of the case 1004 and thus constitutes the appearance of the aerosol generating device 1000 together with the case 1004. The cover 1002 is not an essential component, and if necessary, the cover 1002 may not be installed.

A heater 1300, a control unit 1200, and a battery 1100 may be installed at the case 1004. The case 1004 may constitute the appearance of the aerosol generating device 1000 and may perform a function of accommodating and protecting various components in a space formed therein.

The cover 1002 and the case 1004 may be manufactured of a plastic material that does not transfer heat well, or a metal material coated with a heat shielding material on the surface. The cover 1002 and the case 1004 may be manufactured by, for example, an injection molding method, a three-dimensional (3D) printing method, or a method of assembling small parts manufactured by injection molding.

An external hole 1002*p* into which the cigarette 2000 may be inserted, may be formed in a top surface of the cover 1002. A door 1003 that is movable may be installed at the top surface of the cover 1002. The door 1003 may move to expose the external hole 1002*p* and the insertion hole 1004*p* that allow the cigarette 2000 to pass through the cover 1002 and to be inserted into the case 1004, to the outside.

When the external hole 1002*p* is exposed to the outside by the door 1003, the user may insert the end of the cigarette 2000 into the external hole 1002*p* and the insertion hole 1004*p* to mount the cigarette 2000 on the accommodation part 1400.

The door 1003 may slide along a rail or may be rotatably installed on the cover 1002 through a hinge assembly. The door 1003 may rotate toward the side of the external hole 1002*p* in an extending direction of the top surface of the cover 1002 or may rotate in a direction away from the top surface of the cover 1002.

A button 1009 may be installed at the case 1004. The button may be formed at one side of the case 1004. As the button 1009 is operated, the operation of the aerosol generating device 1000 may be controlled. The button may employ various methods, such as a push button, a slide button, and a touch sensor.

In addition, the aerosol generating device 1000 may further include general-purpose components in addition to the above-described components. For example, the aerosol generating device 1000 may include a display capable of outputting visual information and/or a motor for outputting tactile information. Also, the aerosol generating device 1000 may include at least one sensor (a puff detection sensor, a temperature detection sensor, a sensor for detecting whether the cigarette 2000 is inserted, etc.).

Although not illustrated in FIGS. 1 and 2, the aerosol generating device 1000 and an additional cradle may form together a system. For example, the cradle may be used to charge the battery 1100 of the aerosol generating device 1000. Alternatively, the heater 1300 may be heated when the cradle and the aerosol generating device 1000 are coupled to each other.

Figure 3:
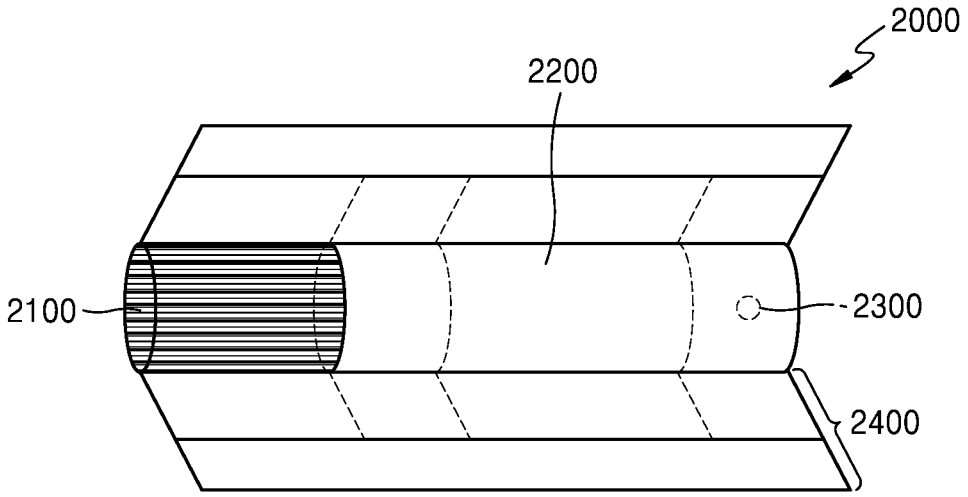
FIG. 3 is a diagram showing a cigarette including an aerosol generating material.

FIG. 3 is a diagram showing a cigarette including an aerosol generating material.

Referring to FIG. 3, the cigarette 2000 includes a tobacco rod 2100 and a filter rod 2200. The filter rod 2200 illustrated in FIG. 3 is illustrated as a single segment, but is not limited thereto. In other words, the filter rod 2200 may include a plurality of segments. For example, the filter rod 2200 may include a first segment configured to cool an aerosol and a second segment configured to filter a certain component included in the aerosol. Also, according to necessity, the filter rod 2200 may further include at least one segment configured to perform other functions.

The cigarette 2000 may be similar as a general combustive cigarette. For example, the cigarette 2000 may be divided into the tobacco rod 2100 including an aerosol generating material and the filter rod 2200 including a filter or the like. Alternatively, the filter rod 2200 of the cigarette 2000 may also include an aerosol generating material. For example, an aerosol generating material made in the form of granules or capsules may be inserted into the filter rod 2200.

The tobacco rod 2100 may be completely inserted into the inside of the aerosol generating device 1000, and the filter rod 2200 may be exposed to the outside. Alternatively, only a portion of the tobacco rod 2100 or a portion of the tobacco rod 2100 and the filter rod 2200 may be inserted into the inside of the aerosol generating device 1000. The user may inhale aerosols while opening the filter rod 2200 with the mouth. At this time, aerosols may be generated when external air passes through the tobacco rod 2100, and the generated aerosols may pass through the filter rod 2200 and may be delivered to the user's mouth.

The cigarette 200 may be packaged via at least one wrapper 2400. The wrapper 2400 may have at least one hole through which external air may be introduced or internal air may be discharged. For example, the cigarette 2000 may be packaged via one wrapper 2400. As another example, the cigarette 2000 may be doubly packaged via at least two wrappers 2400. For example, the tobacco rod 2100 may be packaged via a first wrapper, and the filter rod 2200 may be packaged via a second wrapper. Also, the tobacco rod 2100 and the filter rod 2200, which are respectively packaged via separate wrappers, may be coupled to each other, and the entire cigarette 2000 may be packaged via a third wrapper. When each of the tobacco rod 2100 and the filter rod 2200 includes a plurality of segments, each segment may be packaged via a separate wrapper. Also, the entire cigarette 2000 including the plurality of segments, which are respectively packaged via the separate wrappers and which are coupled to each other, may be re-packaged via another wrapper.

The tobacco rod 2100 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 2100 may include other additives, such as flavors, a wetting agent, and/or organic acid. Also, the tobacco rod 2100 may include a flavored liquid, such as menthol or a moisturizer, which is injected to the tobacco rod 2100.

The tobacco rod 2100 may be manufactured in various forms. For example, the tobacco rod 2100 may be formed as a sheet or a strand. Also, the tobacco rod 2100 may be formed as a pipe tobacco, which is formed of tiny bits cut from a tobacco sheet. Also, the tobacco rod 2100 may be surrounded by a heat conductive material. For example, the heat-conducting material may be, but is not limited to, a metal foil such as aluminum foil. For example, the heat conductive material surrounding the tobacco rod 2100 may uniformly distribute heat transmitted to the tobacco rod 2100, and thus, the heat conductivity applied to the tobacco rod may be increased and taste of the tobacco may be improved. Also, the heat conductive material surrounding the tobacco rod 2100 may function as a susceptor heated by the induction heater 1300. Here, although not illustrated in the drawings, the tobacco rod 2100 may further include an additional susceptor, in addition to the heat conductive material surrounding the tobacco rod 2100.

The filter rod 2200 may include a cellulose acetate filter. Shapes of the filter rod 2200 are not limited. For example, the filter rod 2200 may include a cylinder-type rod or a tube-type rod having a hollow inside. Also, the filter rod 2200 may include a recess-type rod. When the filter rod 2200 includes a plurality of segments, at least one of the plurality of segments may have a different shape.

The filter rod 2200 may be formed to generate flavors. For example, a flavoring liquid may be injected onto the filter rod 2200, or an additional fiber coated with a flavoring liquid may be inserted into the filter rod 2200.

Also, the filter rod 2200 may include at least one capsule 2300. Here, the capsule 2300 may generate a flavor or an aerosol. For example, the capsule 2300 may have a configuration in which a liquid containing a flavoring material is wrapped with a film. For example, the capsule 2300 may have a spherical or cylindrical shape, but is not limited thereto.

When the filter rod 2200 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment cools the aerosol.

Figure 4:
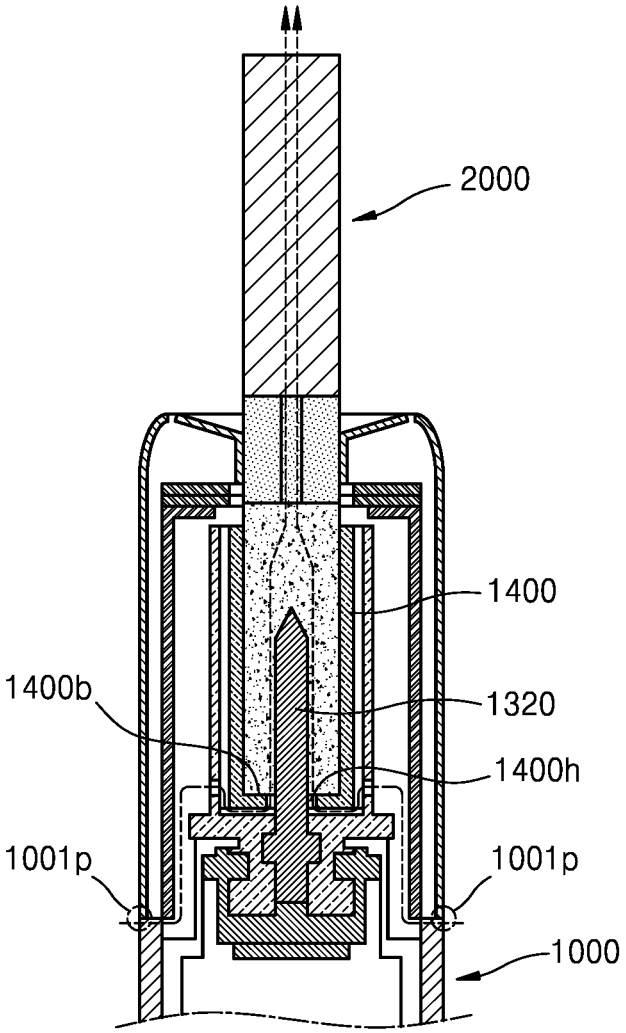
FIG. 4 is a cross-sectional view of the aerosol generating device taken along line A-A' of FIG. 1.

FIG. 4 is a cross-sectional view of the aerosol generating device taken along line A-A' of FIG. 1.

Referring to FIG. 4, when the user puffs, external air may be introduced into the aerosol generating device 1000 through an inlet 1001*p*. The inlet 1001*p* may be a hole formed at one side of the aerosol generating device 1000, or the inlet 1001*p* may be a gap formed between the cover 1002 and the case 1004 when the cover 1002 and the case 1004 are coupled to each other. The inlet 1001*p* may be formed in a single member at one side of the aerosol generating device 1000 or may be formed in plural in a circumferential direction of the aerosol generating device 1000.

According to an embodiment, the opening and closing of the inlet 1001*p* formed at the aerosol generating device 1000 and/or the size of the inlet 1001*p* may be adjusted by the user. Accordingly, the amount of smoke and a smoking impression may be adjusted by the user.

Air introduced through the inlet 1001*p* may reach the heater 1300 along an airflow path inside the aerosol generating device 1000. The airflow path may be provided in various shapes. For example, the airflow path may guide the movement of air from the outer periphery to the center of the aerosol generating device 1000. Alternatively, the airflow path may guide the movement of air upward or downward from the inlet 1001*p*.

The air that reaches the heater 1300 may move to the inside of the accommodation part 1400 through a gap formed due to a difference in cross-sectional areas of the heating element 1320 and the hole 1400*h*. In this case, the amount, speed, pressure, and suction resistance of the air that moves into the accommodation part 1400 may be determined according to a ratio S1/S2 of the cross-sectional area S1 of the hole 1400*h* with respect to the cross-sectional area S2 of the heating element 1320. Also, a degree at which aerosol generating materials such as a tobacco material separated from the cigarette 2000 are exposed to the outside of the accommodation part 1400, may be determined according to the ratio S1/S2 of the cross-sectional area S1 of the hole 1400*h* with respect to the cross-sectional area S2 of the heating element 1320. Also, when considering the temperature distribution in the cigarette 2000 according to the ratio S1/S2 of the cross-sectional area S2 of the hole 1400*h* with respect to the cross-sectional area S2 of the heating element 1320, a region in which airflow is formed, and an aerosol transfer amount accordingly may be determined. This will be described in more detail with reference to FIGS. 7 and 8.

Thereafter, the air may move into the cigarette 2000, and the aerosols vaporized by heating of the heating element 1320 may be delivered upward. In this case, as a ratio S1/S3 of the cross-sectional area S1 of the hole 1400*h* with respect to a cross-sectional area S3 of the cigarette 2000 is adjusted, when considering the temperature distribution in the cigarette 2000, a region in which airflow is formed, and an aerosol transfer amount accordingly may be determined. This will be described in more detail with reference to FIGS. 7 and 8.

Thereafter, the air may be delivered upward together with the aerosols vaporized from the aerosol generating material.

Figure 5:
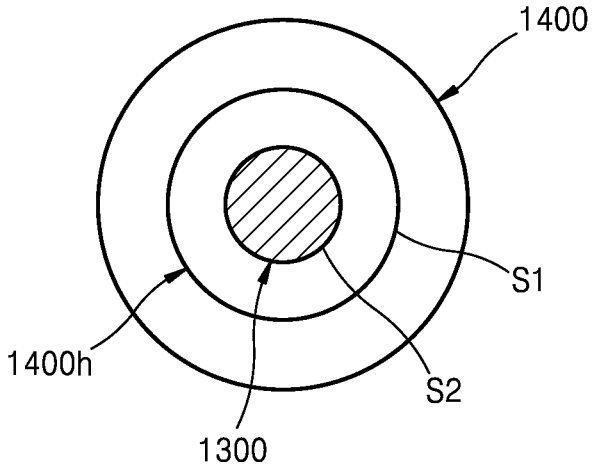
FIG. 5 is a cross-sectional view of the aerosol generating device taken along line B-B' of FIG. 1.

FIG. 5 is a cross-sectional view of the aerosol generating device taken along line B-B' of FIG. 1.

Referring to FIG. 5, the heating element 1320 of the heater 1300 may pass through the hole 1400*h* formed in the bottom surface 1400*b* of the accommodation part 1400 and may be inserted therein. In FIG. 5, the heating element 1320 has the circular cross-sectional area S2. However, the shape of the heating element 1320 is not limited thereto, and the heating element 1320 may have various shapes. This will be described in more detail with reference to FIG. 10.

The B-B' cross-section may be a plane parallel to the bottom surface 1400*b*. This means that the B-B' cross-section may be a plane including the bottom surface 1400*b*. The bottom surface 1400*b* may be on a plane substantially perpendicular to an axis in which the accommodation part 1400 extends.

When the user puffs, the air may move to the inside of the accommodation part 1400 through a gap formed due to a difference in cross-sectional areas of the heating element 1320 and the hole 1400*h* and may move to the inside of the cigarette 2000 so that the aerosols may be delivered to the user.

On the B-B' cross-section, as the ratio S1/S2 of the cross-sectional area S1 of the hole 1400*h* with respect to the cross-sectional area S2 of the heating element 1320 increases, the gap between the heating element 1320 and the hole 1400*h* increases, and as the ratio S1/S2 of the cross-sectional area S1 of the hole 1400*h* with respect to the cross-sectional area S2 of the heating element 1320 decreases, the gap between the heating element 1320 and the hole 1400*h* decreases.

Thus, as the ratio S1/S2 of the cross-sectional area S1 of the hole 1400*h* with respect to the cross-sectional area S2 of the heating element 1320 increases, airflow introduced into the cigarette 2000 may be increased. Thus, the aerosol transfer amount may increase. In other words, in order to obtain a sufficient aerosol transfer amount, the minimum value of the ratio S1/S2 of the cross-sectional area S1 of the hole 1400*h* with respect to the cross-sectional area S2 of the heating element 1320 may be determined.

On the other hand, when the ratio S1/S2 of the cross-sectional area S2 of the hole 1400*h* with respect to the cross-sectional area S2 of the heating element 1320 is greater than and equal to a certain value, the air introduced into the cigarette 2000 may pass through a low-temperature region in the temperature distribution of the cigarette 200, as will be described later with reference to FIG. 7, so that the aerosol transfer amount may no longer increase. That is, the maximum value of the ratio S1/S2 of the cross-sectional area S1 of the hole 1400*h* with respect to the cross-sectional area S2 of the heating element 1320 may be determined considering the increase of the aerosol transfer amount is stagnating.

Also, suction resistance against the air passing through the inside of the accommodation part 1400 through the gap between the heating element 1320 and the hole 1400*h* may be stabilized according to the ratio S1/S2 of the cross-sectional area S1 of the hole 1400*h* with respect to the cross-sectional area S2 of the heating element 1320.

In addition, the leakage of the aerosol generating material separated from the cigarette 2000 through the gap between the heating element 1320 and the hole 1400*h* may be prevented according to the ratio S1/S2 of the cross-sectional area S1 of the hole 1400*h* with respect to the cross-sectional area S2 of the heating element 1320. That is, when the ratio S1/S2 of the cross-sectional area S1 of the hole 1400*h* with respect to the cross-sectional area S2 of the heating element 1320 is greater than and equal to a certain value, the aerosol generating material may leak through the gap between the heating element 1320 and the hole 1400*h*, the maximum value of the ratio S1/S2 of the cross-sectional area S1 of the hole 1400*h* with respect to the cross-sectional area S2 of the heating element 1320 may be determined.

Figure 6:
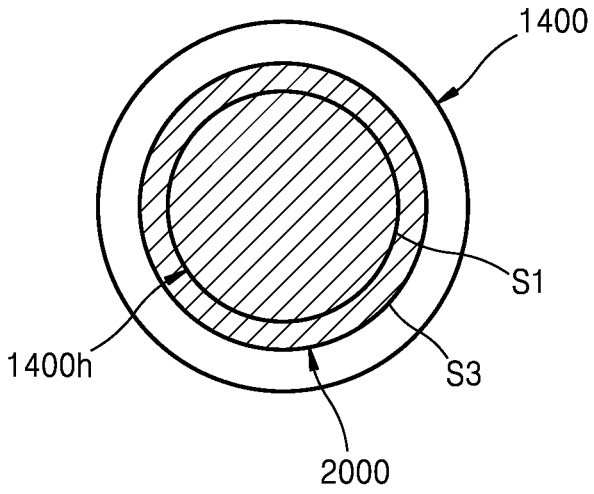
FIG. 6 is a cross-sectional view of the aerosol generating device taken along line B-B' of FIG. 1 in a state in which a cigarette is inserted into the aerosol generating device of FIG. 1.

FIG. 6 is a cross-sectional area of the aerosol generating device taken along line B-B' of FIG. 1 in a state in which a cigarette is inserted into the aerosol generating device of FIG. 1.

On the B-B' cross-section, the cross-sectional area S3 of the cigarette 2000 may be greater than the cross-sectional area S1 of the hole 1400*h* formed in the bottom surface 1400*b* so that a limit point at which the cigarette 2000 is inserted by the bottom surface 1400*b*, may be set.

When the user puffs, the external air may pass through the hole 1400*h* and may be introduced into the cigarette 2000. In this case, a region in the cross-sectional area S3 of the cigarette 200 into which the air is introduced, may be determined according to the ratio S1/S3 of the cross-sectional area S1 of the hole 1400*h* with respect to the cross-sectional area S3 of the cigarette 2000. As will be described later in FIG. 7, the region in the cross-sectional area S3 of the cigarette 2000 in which the air is introduced, may affect the aerosol transfer amount.

Also, the suction resistance may vary according to the ratio S1/S3 of the cross-sectional area S1 of the hole 1400*h* with respect to the cross-sectional area S3 of the cigarette 2000, and the ratio S1/S2 of the cross-sectional area S1 of the hole 1400*h* with respect to the cross-sectional area S2 of the heating element 1320 in which the suction resistance is stabilized, may be determined. For example, as the ratio S1/S3 of the cross-sectional area S1 of the hole 1400*h* with respect to the cross-sectional area S3 of the cigarette 2000 increases, the suction resistance may be reduced.

Figure 7:
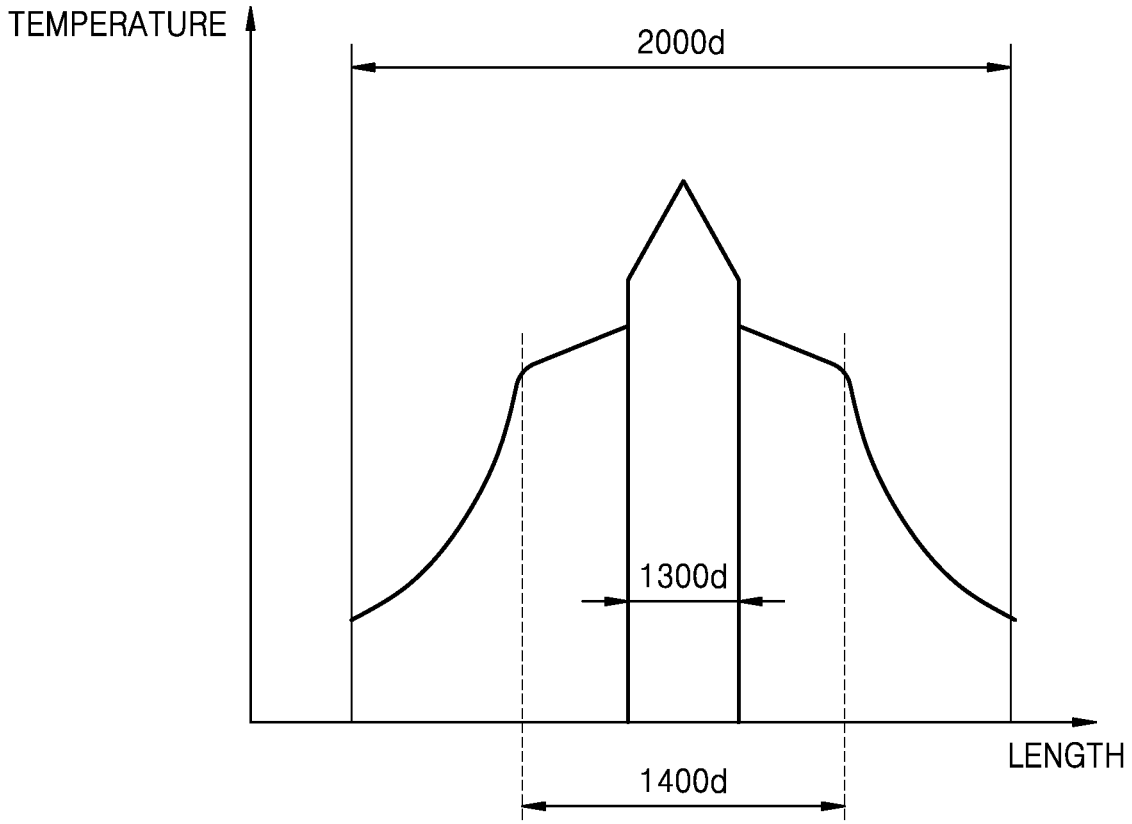
FIG. 7 is a graph showing a temperature distribution within the cigarette inserted into the accommodation part in a cross-section taken along line A-A'.

FIG. 7 is a graph showing a temperature distribution within the cigarette inserted into the accommodation part in a cross-section taken along line A-A'. Referring to FIG. 7, the temperature distribution in which temperature rises due to heating of the heating element 1320 and a change from the center of the cigarette 2000 close to the heating element 1320 to the outer periphery of the cigarette 2000 far away from the heating element 1320 occurs, may be formed inside the cigarette 2000.

For example, a temperature distribution curve may be maintained at a certain high temperature in the center of the cigarette 2000 close to the heating element 1320, and the temperature may decrease away from the heating element 1320. In this case, a slope at which the temperature falls, may be changed. For example, the slope at which the temperature falls, may be gentle, and the temperature may rapidly fall at a point far away from the center by a first certain distance or more. Subsequently, the temperature may be maintained flat at a relatively low temperature from a point far away from the center by a second certain distance or more.

The temperature distribution curve shown in FIG. 7 is just an example and may be changed due to various factors, such as the type of the aerosol generating material, the thermal conductivity of the heating element 1320, and the shape of the heating element 1320.

The aerosol generating material may be vaporized with aerosols when being heated at a certain temperature or more, and the fluidity of the vaporized aerosols may be changed according to a heating temperature. Thus, providing of the airflow to the region heated at a certain temperature or more when the user puffs, considering the temperature distribution in the cigarette 2000 may affect the aerosol transfer amount.

The region in which the airflow is introduced onto the cross-section of the cigarette 2000, may be determined according to the ratio S1/S2 of the cross-sectional area S1 of the hole 1400*h* with respect to the cross-sectional area S2 of the heating element 1320 and the ratio S1/S3 of the cross-sectional area S1 of the hole 1400*h* with respect to the cross-sectional area S3 of the cigarette 2000, and thus the aerosol transfer amount may be changed.

For example, when the region of the cross-section of the cigarette 200 into which the airflow is introduced, is a region maintained at a certain temperature or more, the aerosol transfer amount may be maximized, whereas, when the region into which the airflow is introduced, is a region in which the temperature in the cigarette 2000 is maintained at a low temperature, the aerosol transfer amount may be reduced.

For example, the temperature distribution that is changed according to a distance from the center of the heating element 1320 may be formed inside the cigarette 200 by the heating element 1320 inserted into the cigarette 2000 having a diameter 2000*d*, the heating element 1320 having a diameter 1300*d*, and the hole 1400*h* having a diameter 1400*d* with respect to a region corresponding to a region of temperature is maintained at a high temperature in the periphery of the center of the heating element 1320 may be formed so that the aerosol transfer amount may be maximized.

Figure 8:
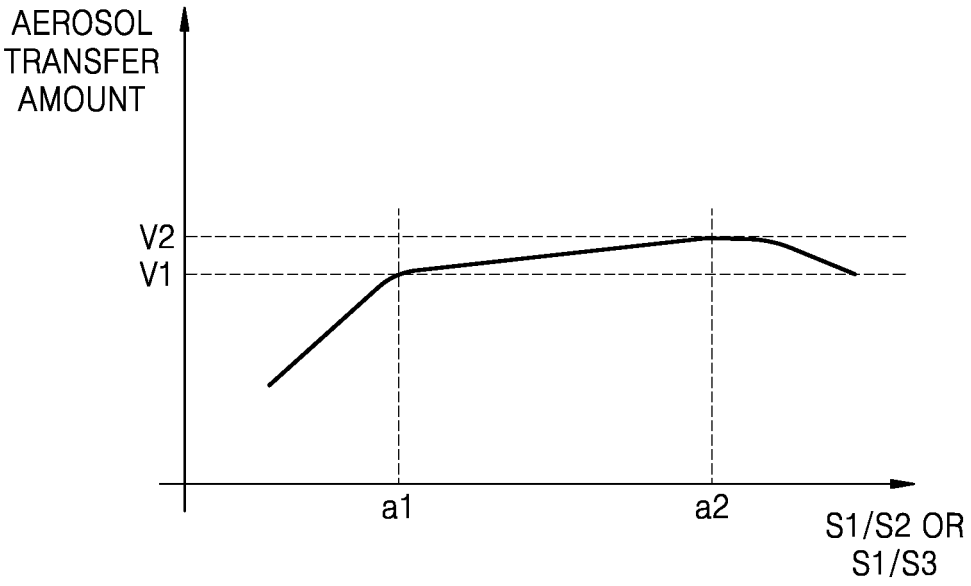
FIG. 8 is a graph showing an aerosol transfer amount.

FIG. 8 is a graph showing an aerosol transfer amount according to the ratio S1/S2 of the cross-sectional area S1 of a hole with respect to the cross-sectional area S2 of a heating element and the ratio S1/S3 of the cross-sectional area S1 of the hole with respect to the cross-sectional area S3 of the cigarette.

Referring to FIG. 8, as the ratio S1/S2 of the cross-sectional area S1 of the hole 1400*h* with respect to the cross-sectional area S2 of the heating element 1320 increases, the aerosol transfer amount may increase. Thereafter, when the ratio S1/S2 of the cross-sectional area S1 of the hole 1400*h* with respect to the cross-sectional area S2 of the heating element 1320 is greater than and equal to a first value a1, the aerosol transfer amount may be stabilized in the range in which it is greater than a first aerosol transfer amount value v1 and is less than a second aerosol transfer amount value v2.

Thereafter, when the ratio S1/S2 of the cross-sectional area S1 of the hole 1400*h* with respect to the cross-sectional area S2 of the heating element 1320 is greater than and equal to a second value a2, the aerosol transfer amount may stagnate at a constant value due to the easing of the increase. Alternatively, the aerosol transfer amount may be reduced. This may be due to a region on the cross-section of the cigarette 2000 through which air flows into the cigarette 2000 and the temperature distribution in the cigarette 2000 as described above with reference to FIG. 7.

The graph of FIG. 8 is an embodiment of an aerosol transfer amount according to the ratio S1/S2 of the cross-sectional area S1 of the hole 1400*h* with respect to the cross-sectional area S2 of the heating element 1320 and the ratio S1/S3 of the cross-sectional area S1 of the hole 1400*h* with respect to the cross-sectional area S3 of the cigarette 200, and the graph may vary due to various factors such as the type of the aerosol generating material, the thermal conductivity of the heating element 1320, and the shape of the heating element 1320.

Also, a change of the aerosol transfer amount shown in FIG. 8 is due to the ratio S1/S3 of the cross-sectional area S1 of the hole 1400*h* with respect to the cross-sectional area S3 of the cigarette 2000 in addition to the ratio S1/S2 of the cross-sectional area S1 of the hole 1400*h* with respect to the cross-sectional area S2 of the heating element 1320, and the above-described matters based on the ratio S1/S2 of the cross-sectional area S2 of the hole 1400*h* with respect to the cross-sectional area S2 of the heating element 1320 may be applied to the change of the aerosol transfer amount according to the ratio S1/S3 of the cross-sectional area S1 of the hole 1400*h* with respect to the cross-sectional area S3 of the cigarette 2000.

Table 1 shows the aerosol transfer amount according to the ratio S1/S2 of the cross-sectional area S1 of the hole 1400*h* with respect to the cross-sectional area S2 of the heating element 1320 and the ratio S1/S3 of the cross-sectional area S1 of the hole 1400*h* with respect to the cross-sectional area S3 of the cigarette 2000.

TABLE 1

| S1/S2 | S1/S3 | Nicotine (mg/stick) | Glycerol (mg/stick) |
|---|---|---|---|
| 1.6 | 0.1 | 1.10 | 3.60 |
| 1.8 | 0.2 | 1.13 | 3.86 |
| 2.1 | 0.2 | 1.19 | 4.05 |
| 2.4 | 0.2 | 1.06 | 3.44 |
| 2.7 | 0.2 | 1.09 | 3.52 |
| 3.0 | 0.3 | 1.08 | 3.48 |
| 3.3 | 0.3 | 1.07 | 3.58 |
| 3.6 | 0.3 | 1.09 | 3.50 |

When the ratio S1/S2 of the cross-sectional area S1 of the hole 1400*h* with respect to the cross-sectional area S2 of the heating element 1320 is greater than and equal to 1.8 and less than and equal to 3.6, it may be checked that the transfer amount of nicotine is measured to be 1.05 mg/stick or more and the transfer amount of glycerol is measured to be 3.50 mg/stick or more. Alternatively, when the ratio S1/S3 of the cross-sectional area S1 of the hole 1400*h* with respect to the cross-sectional area S3 of the cigarette 2000 is greater than and equal to 0.2 and less than and equal to 0.3, it may be checked that the transfer amount of nicotine is measured to be 1.05 mg/stick or more and the transfer amount of glycerol is measured to be 3.50 mg/stick or more.

Figure 9:
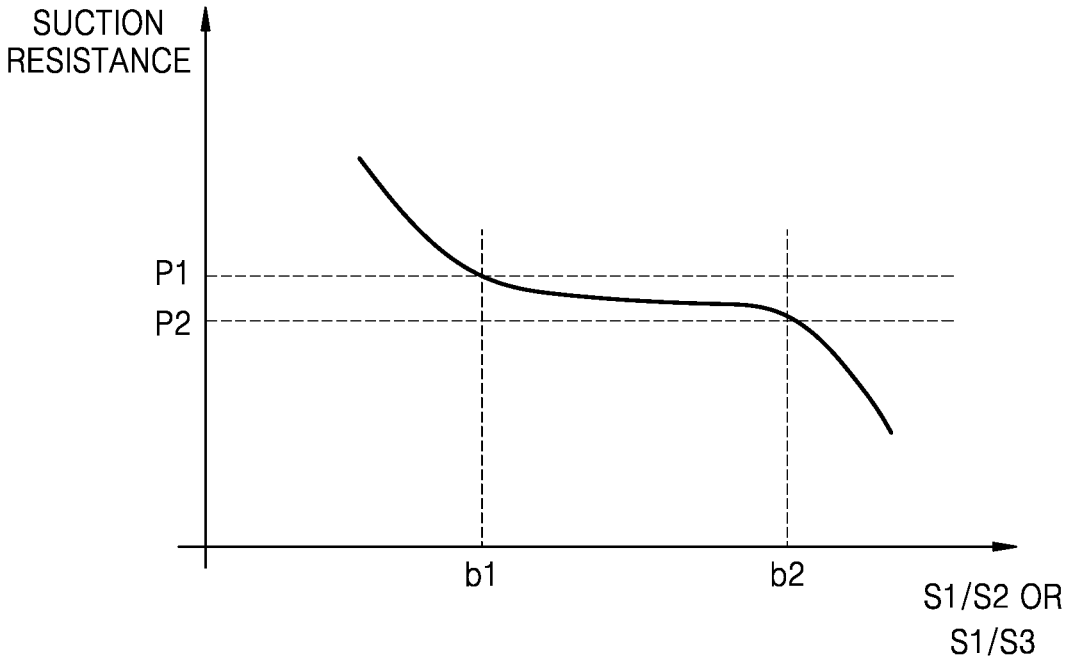
FIG. 9 is a graph showing suction resistance.

FIG. 9 is a graph showing suction resistance according to the ratio S1/S2 of the cross-sectional area S1 of a hole with respect to the cross-sectional area S2 of a heating element and the ratio S1/S3 of the cross-sectional area S1 of the hole with respect to the cross-sectional area S3 of the cigarette.

Referring to FIG. 9, suction resistance may be reduced as the ratio S1/S2 of the cross-sectional area S1 of the hole 1400*h* with respect to the cross-sectional area S2 of the heating element 1320. When the ratio S1/S2 of the cross-sectional area S1 of the hole 1400*h* with respect to the cross-sectional area S2 of the heating element 1320 is greater than and equal to a first value and is less than and equal to a second value, suction resistance may be stabilized in the range in which it is less than and equal to a first suction resistance value P1 and greater than and equal to a second suction resistance value P2. Thereafter, when the ratio S1/S2 of the cross-sectional area S1 of the hole 1400*h* with respect to the cross-sectional area S2 of the heating element 1320 is greater than and equal to a second value b2, suction resistance may be rapidly reduced to a smaller value than the second suction resistance value.

The graph of FIG. 9 is an embodiment of suction resistance according to the ratio S1/S2 of the cross-sectional area S1 of the hole 1400*h* with respect to the cross-sectional area S2 of the heating element 1320 and the ratio S1/S3 of the cross-sectional area S1 of the hole 1400*h* with respect to the cross-sectional area S3 of the cigarette 200, and the graph may vary due to various factors such as the type of the aerosol generating material, the thermal conductivity of the heating element 1320, and the shape of the heating element 1320.

Also, a change of the suction resistance shown in FIG. 9 varies according to the ratio S1/S3 of the cross-sectional area S1 of the hole 1400*h* with respect to the cross-sectional area S3 of the cigarette 2000 in addition to the ratio S1/S2 of the cross-sectional area S1 of the hole 1400*h* with respect to the cross-sectional area S2 of the heating element 1320, and the above-described matters based on the ratio S1/S2 of the cross-sectional area S1 of the hole 1400*h* with respect to the cross-sectional area S2 of the heating element 1320 may be applied to the change of the suction resistance according to the ratio S1/S3 of the cross-sectional area S1 of the hole 1400*h* with respect to the cross-sectional area S3 of the cigarette 2000.

Table 2 shows suction resistance according to the ratio S1/S2 of the cross-sectional area S1 of the hole 1400*h* with respect to the cross-sectional area S2 of the heating element 1320 and the ratio S1/S3 of the cross-sectional area S1 of the hole 1400*h*.

TABLE 2

| S1/S2 | S1/S3 | When no cigarette is inserted, A ($mmH_2O$) | Cigarette, B ($mmH_2O$) | When a cigarette is inserted, C ($mmH_2O$) | Difference value, D = C − B ($mmH_2O$) |
|---|---|---|---|---|---|
| 1.6 | 0.1 | 14 | 50.8 | 85.2 | 34.4 |
| 1.8 | 0.2 | 10 | 51.6 | 78 | 26.4 |
| 2.1 | 0.2 | 10 | 52 | 79 | 27 |
| 2.4 | 0.2 | 10 | 53.8 | 82.2 | 28.4 |
| 2.7 | 0.2 | 10 | 53 | 78.8 | 25.8 |
| 3.0 | 0.3 | 9 | 53.4 | 78.8 | 25.4 |
| 3.3 | 0.3 | 9 | 51.6 | 76.4 | 24.8 |
| 3.6 | 0.3 | 9 | 53.4 | 81 | 27.6 |

TABLE 2-continued

| S1/S2 | S1/S3 | When no cigarette is inserted, A ($mmH_2O$) | Cigarette, B ($mmH_2O$) | When a cigarette is inserted, C ($mmH_2O$) | Difference value, D = C − B ($mmH_2O$) |
|---|---|---|---|---|---|
| 4.0 | 0.4 | 9 | 52.2 | 75.4 | 23.2 |
| 4.4 | 0.4 | 8 | 53.4 | 78.8 | 25.4 |

Table 2 shows suction resistance A of airflow passing through an airflow path including the inlet 1001*p* and the accommodation part 1400 in a state in which the cigarette 2000 is not inserted into the accommodation part 1400, suction resistance B of the airflow independently passing through the cigarette 2000, suction resistance C of the airflow passing through the inlet 1001*b*, the accommodation part 1400, and the cigarette 2000 in a state in which the cigarette 2000 is inserted into the accommodation part 1400, and a difference value D=C−B between the suction resistance B independently passing through the cigarette 2000 and the suction resistance C of the airflow passing the inlet 1001*p*, the accommodation part 1400, and the cigarette 2000 in a state in which the cigarette 2000 is inserted into the accommodation part 1400. According to Table 2, it may be checked that, as the ratio S1/S2 of the cross-sectional area S1 of the hole 1400*h* with respect to the cross-sectional area S2 of the heating element increases, the suction resistance in a state in which the cigarette 2000 is inserted into the accommodation part 1400, decreases.

According to Table 2, when the ratio S1/S2 of the cross-sectional area S1 of the hole 1400*h* with respect to the cross-sectional area S2 of the heating element 1320 is greater than and equal to 1.8 and less than and equal to 3.6, it may be checked that the difference value D between the suction resistance C in a state in which the cigarette 2000 is inserted and the suction resistance B of the cigarette 2000 is stabilized to be greater than and equal to 24 $mmH_2O$ and less than and equal to 29 $mmH_2O$.

Also, when the ratio S1/S3 of the cross-sectional area S1 of the hole 1400*h* with respect to the cross-sectional area S3 of the cigarette 2000 is greater than and equal to 0.2 and less than and equal to 0.3, it may be checked that the difference value D between the suction resistance C in a state in which the cigarette 2000 is inserted and the suction resistance B of the cigarette 2000 is stabilized to be greater than and equal to 24 $mmH_2O$ and less than and equal to 29 $mmH_2O$.

Table 2 shows that, when the ratio S1/S3 of the cross-sectional area S1 of the hole 1400*h* with respect to the cross-sectional area S3 of the cigarette 2000 is small, the difference value D of the suction resistance increasing due to the inserting of the cigarette 2000 is large, whereas, when the ratio S1/S3 of the cross-sectional area S1 of the hole 1400*h* with respect to the cross-sectional area S1 of the hole 1400*h* with respect to the cross-sectional area S3 of the cigarette 2000 is in the range in which it is greater than or equal to 0.2 and less than or equal to 0.3, the difference value D of the suction resistance increasing due to the inserting of the cigarette 2000 is relatively small and stabilized.

Figure 10:
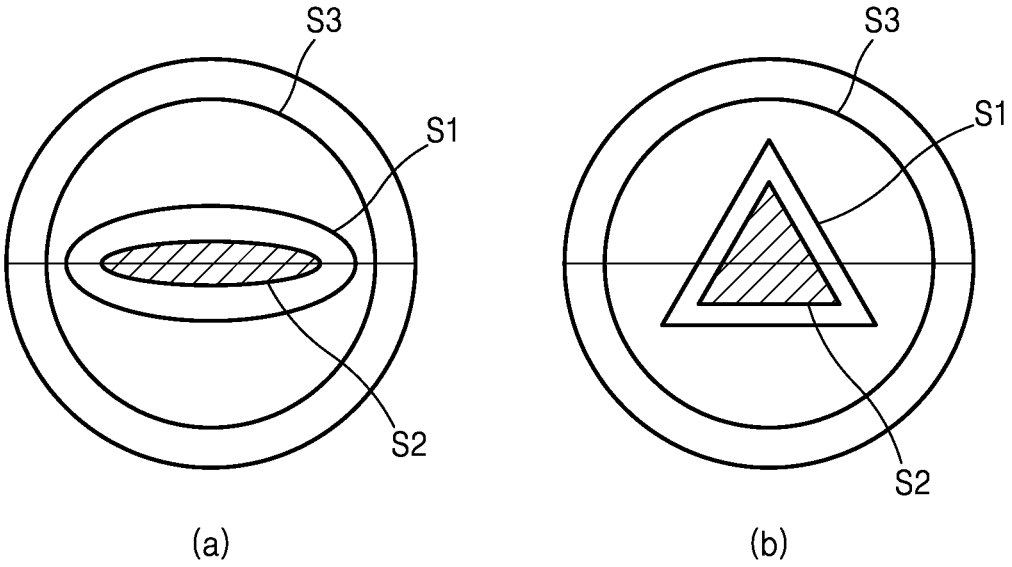
FIG. 10 is a diagram illustrating an accommodation part and a heating element according to another embodiment.

FIG. 10 is a diagram illustrating an accommodation part and a heating element according to another embodiment.

Referring to FIG. 10, the hole 1400*h* may be formed along the shape of the heating element 1320 so that the heating element 1320 may pass through the hole 1400*h*.

For example, when the cross-sectional area S2 of the heating element 1320 is circular, the hole 1400*h* may be circular, and when the cross-sectional area S2 of the heating element 1320 is oval, as shown in FIG. 10A, the hole 1400*h* may be oval to correspond to the cross-sectional area S2 of the heating element 1320. Alternatively, the cross-sectional area A2 of the heating element 1320 may be polygonal, as shown in FIG. 10B. In this case, the hole 1400*h* may be polygonal to correspond to the cross-sectional area S2 of the heating element 1320.

The shapes shown in FIG. 10 are just embodiments of the heating element 1320 and the hole 1400*h* and may be manufactured in various shapes including a slit shape and other polygonal shapes that are not shown in FIG. 10.

In the above, the configuration and features of the present disclosure have been described based on the embodiments according to the present disclosure, but the present disclosure is not limited thereto, and it is understood that various changes or modifications can be made within the spirit and scope of the present disclosure. It will be apparent to those skilled in the art, and therefore, such changes or modifications are found to belong to the appended claims.

The invention claimed is:

1. An aerosol generating device comprising:

an accommodation part into which a cigarette is capable of being inserted; and a heating element passing through a hole formed in a bottom surface of the accommodation part, protruding into the accommodation part and capable of heating the cigarette inserted into the accommodation part, wherein, on the bottom surface, in a plan view downward into the accommodation part, a ratio of a cross-sectional area of the hole with respect to a cross-sectional area of the heating element is greater than or equal to 1.8 and less than or equal to 2.1 such that aerosol transfer through the cigarette is promoted, and wherein, on the bottom surface, in a plan view downward into the accommodation part, a ratio of the cross-sectional area of the hole with respect to the cross-sectional area of the cigarette is greater than or equal to 0.2 and less than or equal to 0.3 such that suction resistance against air passing through the accommodation part is stabilized.

2. The aerosol generating device of claim 1, wherein, when the ratio of the cross-sectional area of the hole with respect to the cross-sectional area of the heating element is greater than or equal to 1.8, suction resistance against air passing through an inside of the accommodation part through a gap formed due to a difference in the cross-sectional areas of the heating element and the hole is stabilized.

3. The aerosol generating device of claim 1, wherein, when the ratio of the cross-sectional area of the hole with respect to the cross-sectional area of the heating element is less than or equal to 2.1, leakage of an aerosol generating material separated from the cigarette through a gap formed due to cross-sectional areas of the heating element and the hole is prevented.

4. The aerosol generating device of claim 1, wherein the bottom surface of the accommodation part is on a plane perpendicular to an axis extending along the accommodation part.

5. The aerosol generating device of claim 1, wherein the heating element passes through the hole in a first direction of an axis, extending along the accommodation part, and the cigarette is inserted into the accommodation part in a second direction of the axis.

6. The aerosol generating device of claim 1, wherein the hole is formed along a shape of the heating element so that the heating element passes through the hole.

7. The aerosol generating device of claim 1, wherein the heating element comprises an elongating-type heating element, and the cross-sectional area of the heating element is circular.

8. The aerosol generating device of claim 1, wherein the hole is circular.

9. The aerosol generating device of claim 1, further comprising an inlet into which external air is introduced, when a user puffs.

10. The aerosol generating device of claim 1, further comprising:

a battery configured to supply power to the heating element; and a control unit configured to control a heating operation of the heating element.

11. The aerosol generating device of claim 1, wherein the heating element is inserted into the cigarette and heated to form a temperature distribution in the cigarette that is changed according to a distance from the heating element, and a region in which air flows into the cigarette through the hole, is determined according to the ratio of the cross-sectional area of the hole with respect to the cross-sectional area of the cigarette.

* * * * *